US005522466A

United States Patent [19]

Harada et al.

[11] Patent Number: 5,522,466

[45] Date of Patent: Jun. 4, 1996

[54] VIBRATION-DAMPING STRUCTURE FOR ELECTRIC HAMMER

[75] Inventors: Mutsuo Harada; Akihisa Yahagi, both of Hitachinaka, Japan

[73] Assignee: Hitachi Koki Company Limited, Tokyo, Japan

[21] Appl. No.: 405,992

[22] Filed: Mar. 17, 1995

[30] Foreign Application Priority Data

Oct. 28, 1994 [JP] Japan ..... 6-265603

[51] Int. Cl.[6] ..... B25D 17/00

[52] U.S. Cl. ..... 173/162.2; 267/141.3

[58] Field of Search ..... 173/162.2, 162.1, 173/211; 267/141, 141.1, 141.3, 141.5

[56] References Cited

U.S. PATENT DOCUMENTS

| | | | |
|---|---|---|---|
| 3,972,119 | 8/1976 | Bailey | 173/162.1 |
| 4,800,965 | 1/1989 | Keller | 173/162.2 |
| 5,038,480 | 8/1991 | Naslund | 173/162.2 |
| 5,052,500 | 10/1991 | Ohtsu | 173/162.2 |
| 5,370,193 | 12/1994 | Sippus et al. | 173/162.1 |
| 5,400,860 | 1/1995 | Best et al. | 173/162.2 |

FOREIGN PATENT DOCUMENTS

| | | | |
|---|---|---|---|
| 476802 | 12/1952 | Italy | 267/141.3 |
| 48-89069 | 10/1973 | Japan . | |
| 482067 | 3/1938 | United Kingdom | 267/141.3 |

*Primary Examiner*—Scott A. Smith
*Attorney, Agent, or Firm*—Pollock, Vande Sande & Priddy

[57] ABSTRACT

A vibration-damping apparatus for an electric hammer unit is provided. This vibration-damping apparatus is provided with the so-called transatory unit including elastic bars disposed between elastic damper members connected to a tool body and a handle of the electric hammer unit, respectively, for absorbing relative displacement of the elastic damper members caused by vibrations produced by the tool body during use. The vibration-damping apparatus further includes a stopper member attached to the elastic damper member attached to the handle so as to engage a chamber formed in the elastic damper member attached to the tool body for preventing the handle from being dislodged from the tool body even when the handle is swung laterally by a hammer operator. Additionally, each of the elastic bars includes a large-diameter portion and a small-diameter portion so as to allow the large-diameter portion to be deformed toward the small-diameter portion during the relative displacement of the elastic damper members for increasing the life of the bars.

8 Claims, 3 Drawing Sheets

VIBRATION-DAMPING STRUCTURE FOR ELECTRIC HAMMER

BACKGROUND OF THE INVENTION

1. Technical Field

The present invention relates generally to am improvement on an electric hammer, and more particularly to an improved vibration-damping structure of an electric hammer designed to absorb vibrations generated by a tool body for preventing them from being transmitted to an operator.

2. Background Art

Japanese Utility Model First Publication No. 48-89069 discloses a vibration proofing structure of an electric hammer which includes the so-called transatory unit having elastic damper members mounted on a tool body and a handle, respectively. The elastic damper members connect with each other through elastic bars. During use of the electric hammer, relative movement of the elastic damper members due to vibrations transmitted from the tool body causes the elastic bars to be compressed while rolling, thereby dampening the vibrations.

Usually, when such an electric hammer is caught in, for example, reinforcing steel bars during use, it is swung laterally by the operator for removal. However, since the tool body and the handle are coupled only through the elastic bars, it is difficult to withstand a strong drawing force exerted by the operator, which may cause the handle to be separated undesirably from the tool body.

SUMMARY OF THE INVENTION

It is therefore a principal object of the present invention to avoid the disadvantages of the prior art.

It is another object of the present invention to provide an improved vibration-damping structure for an electric hammer including the so-called transatory unit designed to allow the hardness and rigidity of elastic damper members to be decreased without degrading non-linear spring characteristics offered by rolling and compression of the elastic damper members during vibrations.

According to one aspect of the present invention, there is provided a vibration-damping apparatus for an electric hammer unit which comprises elastic bar members disposed between a tool body and a handle of the electric hammer unit, the tool body producing vibrations during use of the electric hammer unit; a first elastic damper member, attached to the tool body of the electric hammer, having formed therein first recessed portions; a second elastic damper member, connected to the handle of the electric hammer unit, having formed therein second recessed portion, the second recessed portion defining together with the first recessed portions of the first elastic damper member bar member guiding paths for guiding rolling of the elastic bar members while allowing compression caused by relative movement of the first elastic damper member and the second elastic damper member during the vibrations of the tool body for dampening the vibrations; and a stopper member attached to the second elastic damper member, the stopper member engaging the first elastic damper member so as to allow a given degree of movement of the handle relative to the tool body of the electric hammer unit for preventing the handle from being dislodged from the tool body.

In the preferred mode of the invention, the first elastic damper member has formed therein a chamber for receiving the stopper member.

The stopper is made of an elastic member having a cylindrical portion and a supporting portion connecting the cylindrical portion with the second elastic damper member. The first elastic damper member has formed therein a chamber receiving the cylindrical portion and a groove communicating with the chamber through which the supporting portion pass.

Protrusions are formed on the first elastic damper member. Each of the protrusions engage a shoulder portion defined between the large-diameter portion and the small-diameter portion of each of the elastic bar members for preventing each of the elastic bar members from being dislodged from the electric hammer unit during use of the electric hammer unit.

According to another aspect of the present invention, there Is provided a vibration-damping apparatus for an electric hammer unit which comprises elastic bar members disposed between a tool body and a handle of the electric hammer unit, the tool body producing vibrations during use of the electric hammer unit; a first elastic damper member, attached to the tool body of the electric hammer, having formed therein first recessed portions; a second elastic damper member, connected to the handle of the electric hammer unit, having formed therein second recessed portion, the second recessed portion defining together with the first recessed portions of the first elastic damper member bar member guiding paths for guiding rolling of the elastic bar members while allowing compression caused by relative movement of the first elastic damper member and the second elastic damper member during the vibrations of the tool body for dampening the vibrations, wherein each of the elastic bar members includes a large-diameter portion and a small-diameter portion for allowing the large-diameter portion to be deformed, toward the small-diameter portion, caused by the relative movement of the first elastic damper member and the second elastic damper member during the vibrations of the tool body.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
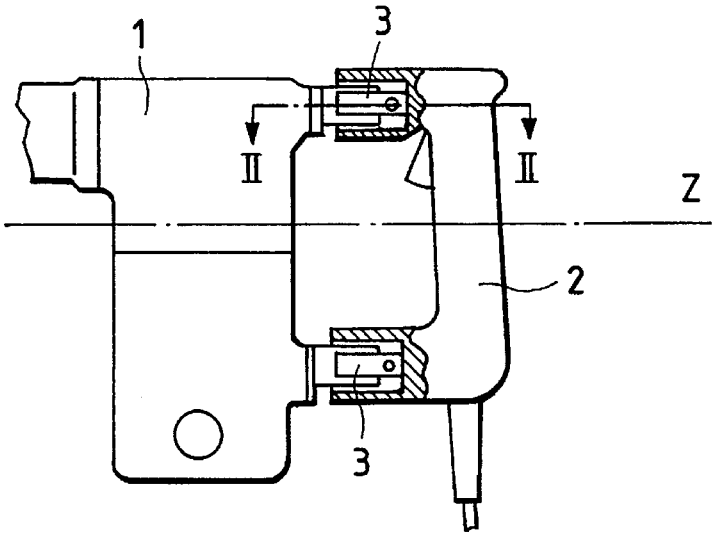
FIG. 1 is a side view which shows an electric hammer having a vibration-damping structure according to the present invention.

Referring now to the drawings, wherein like numbers refer to like parts in several views, particularly to FIG. 1, there is shown an electric hammer unit having a vibration-damping structure according to the present invention.

The electric hammer unit generally includes a tool body 1 and an operator-held handle 2. The handle 2 connects with the tool body 1 through connectors, or coupling units 3 to be isolated from vibrations produced by the tool body 1 during use. The coupling units 3 are arranged at a given interval away from each other in a lengthwise direction of the tool body 1.

Figure 2:
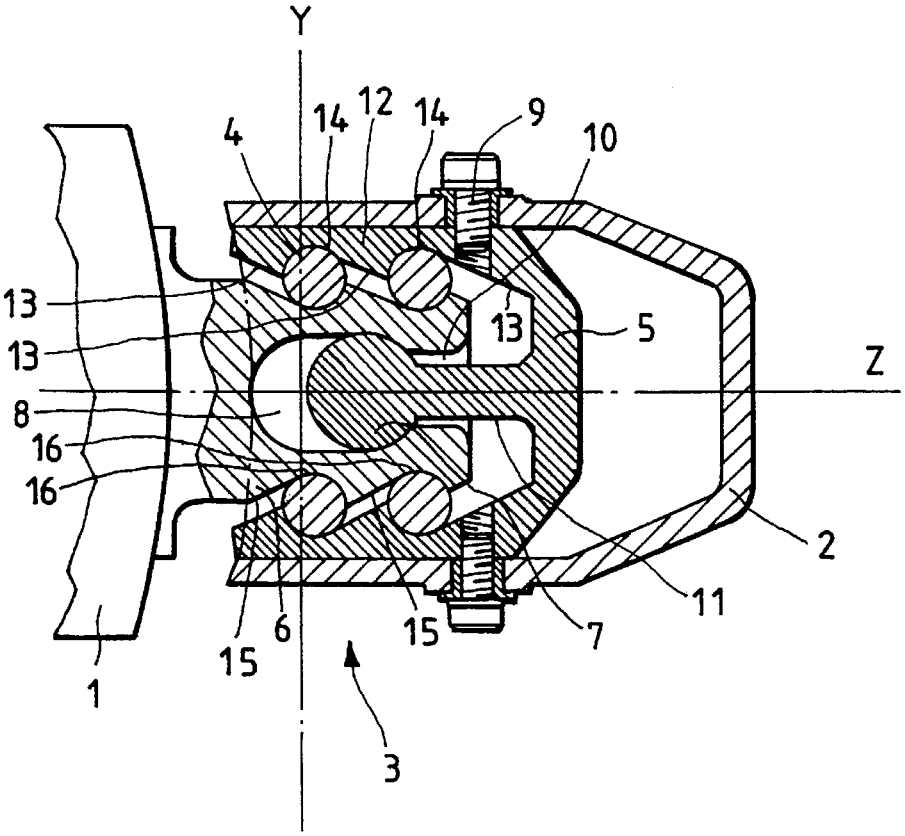
FIG. 2 is a cross sectional view taken along the line II—II in FIG. 1.

Each of the coupling units 3, as shown in FIG. 2, includes an elastic damper member 5 of substantially E-shape in cross section, an elastic damper member 6 attached to the tool body 1, and four elastic round bars 4. The elastic damper member 5 engages the elastic damper member 6 through the round bars 4. These elastic members are formed with rubber or any other suitable materials assuming desired vibration-damping characteristics.

The handle 2 covers the elastic damper member 5 and is coupled thereto through bolts 9. The elastic damper member 5 includes a damper portion 12 of C-shaped cross section, a cylindrical portion 7, and a supporting member 11 connecting between the damper portion 12 and the cylindrical portion 7. The damper portion 12 has on its inner wall inclined surfaces 13 and recessed portions, or grooves 14 between the adjacent inclined surfaces 13. The grooves 14 extend in a direction perpendicular to the drawing. Similarly, the elastic damper member 6 has on its outer side wall inclined surfaces 15 and grooves 16. Each of the grooves 16, as can be seen in the drawing, defines a retaining chamber for one of the round bars 4 together with a corresponding one of the grooves 14 of the elastic damper member 5. The inclined surfaces 13 and 15 of the elastic damper members 5 and 6 are angularly oriented to extend in parallel at a given gap away from each other through the round bars 4. These arrangements complete the so-called Transatory Unit.

The elastic damper member 6 has formed therein a chamber, or cylindrical groove 8 and an elongated opening 10. Disposed within the cylindrical groove 8 is the cylindrical portion 7 of the elastic damper member 6. The cylindrical portion 7 engages an inner wall of the groove 8 in the illustrated manner to serves as a stopper for preventing the handle 2 from being dislodged from the tool body 1, for example, when an end of a hammer tool is caught firmly in reinforcing steel bars and then a hammer operator draws the hammer unit powerfully. The cylindrical portion 7 is also retained in the groove 8 slidably in a lateral direction, as viewed in FIG. 2 (i.e., a direction Z) to allow a given degree of rotational movement of the handle 2 by the hammer operator in a clockwise or counterclockwise direction, as viewed in FIG. 1. Additionally, the supporting portion 11 passes through the elongated opening 10 with a given clearance to connect the cylindrical portion 7 elastically with the damper portion 12 so as to allow a given degree of movement of the handle 2 in a lateral direction of the tool body 1 (i.e., a direction Y in FIG. 2), and restricts a further greater movement of the handle 2 in engagement with an inner wall of the elongated opening 10.

In operation, when vibrations are generated from the tool body 1 during use in the direction Z, the elastic damper member 6 is elastically deformed in the direction Z, developing relative displacement of the elastic damper members 5 and 6. This relative displacement will cause the inclined surfaces 13 and 15 of the elastic damper members 5 and 6 to move to each other so as to decrease the gaps between the inclined surfaces 13 and 15, compressing the round bars 4 while allowing rolling motion to exhibit non-linear spring characteristics so that the handle 2 is isolated from the vibrations transmitted from the tool body 1 with high efficiency. The non-linear spring characteristics serve to withstand a strong pressing force exerted by the hammer operator during use of the hammer unit to enhance a vibration-damping effect.

Figure 3:
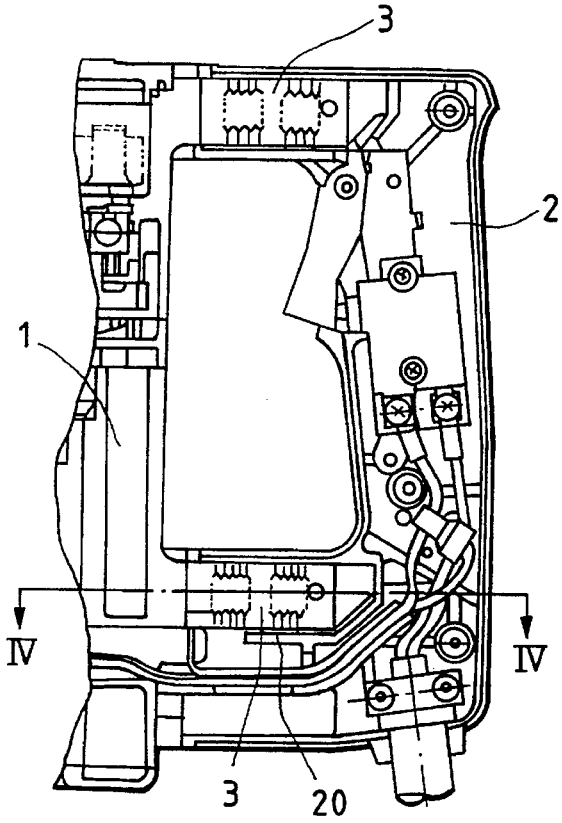
FIG. 3 is a vertical sectional view which shows part of an electric hammer having a vibration-damping structure according to an alternative embodiment of the invention.
Figure 4:
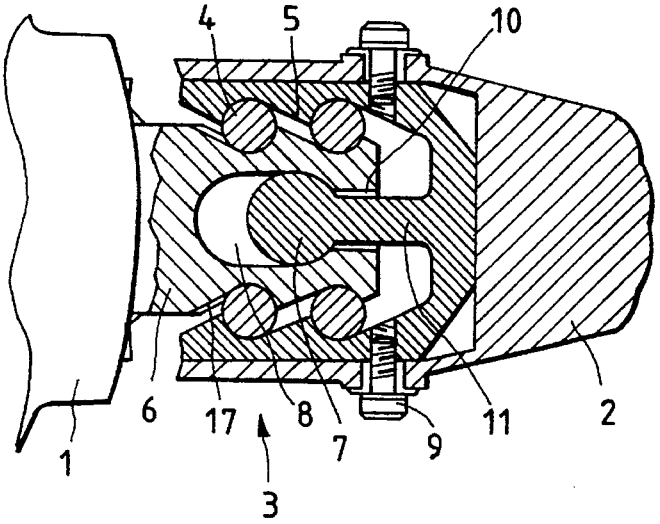
FIG. 4 is a cross sectional view taken along the line IV-IV in FIG. 3.
Figure 5:
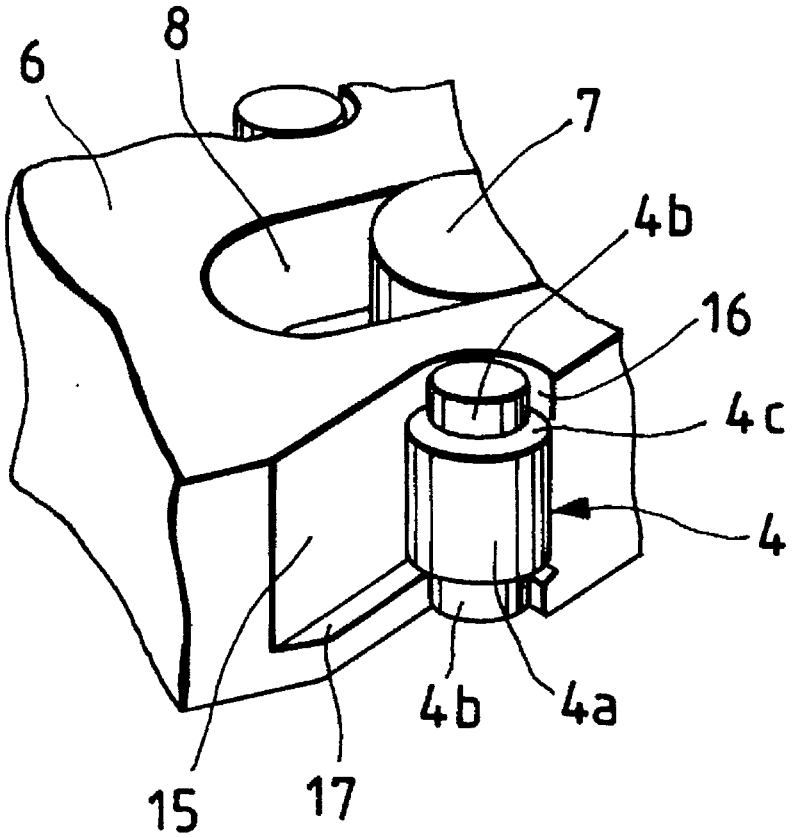
FIG. 5 is a partially perspective view which shows engagement of an elastic round bar with an elastic damper member according to the alternative embodiment shown in FIG. 4.

Referring to FIGS. 3 to 5, there is shown an alternative embodiment of the coupling units 3 according to the present invention. The same reference numbers as employed in the above first embodiment indicate substantially the same parts and explanation thereof in detail will be omitted here.

As can be seen in FIGS. 4 and 5, each of the coupling units 3 includes elastic round bars 4 each having stepped portions and an elastic damper member 6 having a bar guiding rail 7.

The elastic damper member 6, unlike the first embodiment, engages an inner bottom wall of the cover 2, as shown in FIG. 4. The bar guiding rails 7 each project outward from both the inclined surfaces 15 and the grooves 16 for guiding rolling motion of the bars 4 and serving as a stopper to prevent downward dislodgement into engagement with inner walls 20 of the handle 2 during use of the electric hammer, which will cause wear of ends of the bars 4.

Each of the bars 4, as can be seen in FIG. 5, includes a large-diameter central portion 4*a*, small-diameter end portions 4*b*, and shoulder portions 4*c*. The lower of the small-diameter end portions 4*b* and the lower of the shoulder portions 4*c* engage the bar guiding rail 7. With these arrangements, relative displacement of the elastic damper members 5 and 6 during vibrations of the tool body 1 causes each of the bars 4 to roll and be compressed while allowing deformation in an axial direction thereof. This improves the life of the bars 4, and allows the spring constant to be decreased for enhancing the vibration-damping effect.

While the present invention has been disclosed in terms of the preferred embodiment in order to facilitate a better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A vibration-damping apparatus for an electric hammer unit comprising:

elastic bar members disposed between a tool body and a handle of the electric hammer unit, the tool body producing vibrations during use of the electric hammer unit;

a first elastic damper member, attached to the tool body of the electric hammer, having formed therein first recessed portions;

a second elastic damper member, connected to the handle of the electric hammer unit, having formed therein second recessed portions, said second recessed portions defining together with the first recessed portions of said first elastic damper member bar member guiding paths for guiding rolling of said elastic bar members while allowing compression caused by relative movement of said first elastic damper member and said second elastic damper member during the vibrations of the tool body for dampening the vibrations; and a stopper member attached to said second elastic damper member, said stopper member engaging the first elastic damper member so as to allow a given degree of movement of the handle relative to the tool body of the electric hammer unit for preventing the handle from being dislodged from the tool body.

2. A vibration-damping apparatus as set forth in claim 1, wherein said the first elastic damper member has formed therein a chamber for receiving said stopper member.

3. A vibration-damping apparatus as set forth in claim 1, wherein said stopper is made of an elastic member having a cylindrical portion and a supporting portion connecting the cylindrical portion with said second elastic damper member, and said first elastic damper member has formed therein a chamber receiving the cylindrical portion and a groove communicating with the chamber through which the supporting portion pass.

4. A vibration-damping apparatus as set forth in claim 1, wherein each of said elastic bar members includes a large-diameter portion and a small-diameter end portion.

5. A vibration-damping apparatus as set forth in claim 4, further comprising protrusions formed on said first elastic damper member, each of the protrusions engaging a shoulder portion defined between the large-diameter portion and the small-diameter portion of each of said elastic bar members for preventing each of said elastic bar members from being dislodged from the electric hammer unit during use of the electric hammer unit.

6. A vibration-damping apparatus as set forth in claim 1, wherein each of said elastic bar members includes a large-diameter central portion and small-diameter end portions.

7. A vibration-damping apparatus for an electric hammer unit comprising:

elastic bar members disposed between a tool body and a handle of the electric hammer unit, the tool body producing vibrations during use of the electric hammer unit;

a first elastic damper member, attached to the tool body of the electric hammer, having formed therein first recessed portions;

a second elastic damper member, connected to the handle of the electric hammer unit, having formed therein second recessed portions, said second recessed portions defining together with the first recessed portions of said first elastic damper member bar member guiding paths for guiding rolling of said elastic bar members while allowing compression caused by relative movement of said first elastic damper member and said second elastic damper member during the vibrations of the tool body for dampening the vibrations, wherein each of said elastic bar members includes a large-diameter portion and a small-diameter portion for allowing the large-diameter portion to be deformed, toward the small-diameter portion, caused by the relative movement of said first elastic damper member and said second elastic damper member during the vibrations of the tool body.

8. A vibration-damping apparatus as set forth in claim 7, further comprising protrusions formed on said first elastic damper member, each of the protrusions engaging a shoulder portion defined between the large-diameter portion and the small-diameter portion of each of said elastic bar members for preventing each of said elastic bar members from being dislodged from the electric hammer unit during use of the electric hammer unit.

* * * * *